United States Patent [19]

Tsuji et al.

[11] Patent Number: 4,846,603

[45] Date of Patent: Jul. 11, 1989

[54] SET-UP/DOWN PLURAL-SPAN WEIR ASSEMBLY MADE OF FLEXIBLE SHEETS

[75] Inventors: Yoshiomi Tsuji; Ichiro Maruyama; Kenji Mori; Souji Nishikawa, all of Osaka, Japan

[73] Assignee: Sumitomo Electric Industries, Ltd., Osaka, Japan

[21] Appl. No.: 211,015

[22] Filed: Jun. 24, 1988

[30] Foreign Application Priority Data

Jun. 25, 1987 [JP] Japan ..... 62-159147
Jun. 25, 1987 [JP] Japan ..... 62-159148

[51] Int. Cl.[4] ..... E02B 7/20
[52] U.S. Cl. ..... 405/115; 405/91
[58] Field of Search ..... 405/115, 114, 107, 91, 405/87, 80

[56] References Cited

FOREIGN PATENT DOCUMENTS 0013812 1/1983 Japan ..... 405/115
0069912 4/1983 Japan ..... 405/115
0078912 4/1986 Japan ..... 405/115
1600939 10/1981 United Kingdom ..... 405/115

*Primary Examiner*—Dennis L. Taylor
*Attorney, Agent, or Firm*—Cushman, Darby & Cushman

[57] ABSTRACT

A set-up/down plural-span weir assembly is made of flexible sheets and comprises a plurality of single-span weirs coupled to each other through pillars across the stream of a river. A pressure medium is introduced into the bags of the single-span weirs to inflate them to set up the single-span weirs and also discharged therefrom to deflate them to set down the single-span weirs. The upstream water of the weir assembly is directly introduced from an upstream water level detection pipe into a bucket or float container of at least one of the single-span weirs, and is indirectly introduced from the upstream water level detection pipe into the bucket or float container of at least another one of the single-span weirs through the bucket or float container of the former one of the single-span weirs or through that of still another one of the single-span weirs.

2 Claims, 7 Drawing Sheets

SET-UP/DOWN PLURAL-SPAN WEIR ASSEMBLY MADE OF FLEXIBLE SHEETS

BACKGROUND OF THE INVENTION

1. Field of the Invention

The present invention relates to a set-up/down weir made of a flexible sheet, and particularly relates to a set-up/down plural-span weir assembly made of flexible sheets and improved in set-down means based on the level of water upstream of the weir assembly.

2. Description of the Prior Art

A weir made of a flexible sheet such as a rubberized cloth and capable of being set up and down is provided with a bag made of the flexible sheet and mounted on at least the bed of a river or the like across the stream thereof, as disclosed in the Japanese Patent Publication Nos. 11702/65 and 2371/69. A pressure medium such as air, water, both of them or the like is introduced into the bag to inflate it to set up the weir. The pressure medium in the bag is discharged therefrom to deflate it to set down the weir.

A plurality of such single-span weirs can be installed in a river of large width across the stream thereof to facilitate the regulation of the level or flow rat of water, the removal of deposited earth and sand, the shut-off of the river or the like. In that case, the single-span weirs are coupled to each other through pillars so that a set-up/down plural-span weir assembly is constituted. The number of the single-span weirs to be thus coupled is not single, but may be two, three or more.

The single-span weirs of a conventional set-up/down plural-span weir assembly of such kind are provided with set-down means which do not act in conjunction with each other but act separately from each other, as shown in FIGS. 6 and 7, so that the single-span weirs are set down by the set-down means when the upstream water of the weir assembly has reached prescribed levels, respectively.

The set-down means of such a conventional set-up/down plural-span weir assembly shown in FIG. 6 are of a bucket type. When the upstream water W of the weir assembly has reached an automatic set-down level $L_1$, the upstream water W flows into buckets 11*a* and 11*c* to move down the buckets to open butterfly valves 8*a* and 8*c* thereby to deflate the bags 1*a* and 1*c* of the single-span weirs of the assembly. As a result, the single-span weirs are set down. When the up-stream water W has reached another automatic set-down level $L_2$, the upstream water W flows into another bucket 11*b* to move down the bucket to open another butterfly valve 8*b* therby to deflate the bag 1*b* of the other single-span weir of the assembly. As a result, the other single-span weir is set down.

The set-down means of such a conventional set-up/down plural-span weir assembly shown in FIG. 7 are of a float type. When the upstream water W of the weir assembly has reached an automatic set-down level $L_1$, the upstream water flows into float containers 21*a*, 21*b* and 21*c* to lift floats 24*a*, 24*b* and 24*c* to the same level to open butterfly valves 8*a* and 8*c* by rods 22*a* and 22*c* coupled to the floats 22*a* and 24*c*, therby to deflate the bags 1*a* and 1*c* of the single-span weirs of the assembly. As a result, the single-span weirs are set down. When the upstream water W has reached another automatic set-down level $L_2$, the float 4*b* is lifted further to open a butterfly valve 8*a* by a rod 22*b* coupled to the float, to deflate the bag 1*b* of the other single-span weir of the assembly. As a result, the other single-span weir is set down.

As understood from the above description, the single-span weirs of each of the conventional plural-span weir assemblies cannot be set down in prescribed order without presetting a plurality of different set-down levels for the upstream water. However, it is desired for the following reasons (1) and (2) that the single-span weirs can be set down in prescribed order (for example, each of the single-span weirs or every plurality of them can be sequentially set down) without presetting a plurality of different set-down levels for the upstream water.

(1) As for the discharge of stored water at the time of low level of the upstream water or at the slow gradient of the river or the like, it takes much time to store enough water upstream of the weir assembly set up again after being set down completely. In that case, it is not easy to obtain enough water shortly. For that reason, each of the single-span weirs of the assembly or every plurality of the single-span weirs, for example, should be sequentially set down according to the rate of increase of the upstream water so that the discharged quantity of stored water upstream of the weir assembly is reduced as much as possible.

(2) It is preferable that water can be always obtained from the weir assembly for electricity generation, tape water supply or the like. For that reason, the upstream water of the weir assembly should be maintained on a prescribed level or above it. If the upstream water is to be discharged downstream, the single-span weirs of the assembly should not be all set down simultaneously but each of the single-span weirs or every plurality of them, for example, should be sequentially set down according to the rate of increase of the upstream water to keep the level of the upstream water as high as possible.

SUMMARY OF THE INVENTION

The present invention was made in consideration of the above-mentioned circumstances.

Accordingly, it is an object of the present invention to provide a set-up/down plural-span weir assembly which is made of flexible sheets and comprises a plurality of single-span weirs and bucket-type set-down means by which the single-span weirs can be set down in prescribed order on the same level of the upstream water of the weir assembly. Bags made of the flexible sheets and constituting the bodies of the single-span weirs are mounted on the bed of a river. A pressure medium such as air and water is introduced into the bags to inflate them to set up the single-span weirs. The pressure medium in the bags is discharged therefrom to deflate them to set down the single-span weirs. The single-span weirs are coupled to each other through pillars across the stream of the river so that the set-up/down plural-span weir assembly is constituted. The single-span weirs are provided with the bucket-type set-down means in which the upstream water is introduced into the buckets of the single-span weirs through an upstream water level detection pipe to move down the buckets to open air or water discharge valves in air or water discharge pipes communicating with the bags of the single-span weirs, to deflate the bags as the upstream is on the prescribed level. The set-up/down plural-span weir assembly is characterized in that the upstream water is directly introduced from the upstream water level detection pipe into the bucket of at least one of the single-span weirs; and the upstream water is indirectly introduced from the upstream water level detection pipe into the bucket of at least another one of the single-span weirs through the bucket of the former one of the single-span weirs or through the bucket of still another one of the single-span weirs.

It is another object of the present invention to provide a set-up/down plural-span weir assembly which is made of flexible sheets and comprises a plurality of single-span weirs and float-type set-down means in which the single-span weirs can be set down in prescribed order on the same level of the upstream water to the weir assembly. Bags made of the flexible sheets and constituting the bodies of the single-span weirs are mounted on the bed of a river. A pressure medium such as air and water is introduced into the bags to inflate them to set up the single-span weirs. The pressure medium in the bags is discharged therefrom to deflate them to set down the single-span weirs. The single-span weirs are coupled to each another through pillars across the stream of the river so that the set-up/down plural-span weir assembly is constituted. The single-span weirs are provided with the float-type set-down means in which the upstream water is introduced into the float containers of the single-span weirs through an upstream water level detection pipe to move up the floats of the weirs to open air or water discharge valves in air or water discharge pipes communicating with the bags of the single-span weirs, to deflate the bags as the up-stream water is on the prescribed level. The set-up/down plural-span weir assembly is characterized in that the upstream water is directly introduced from the upstream water level detection pipe into the float container of at least one of the single-span weirs; and the upstream water is indirectly introduced from the upstream water level detection pipe into the float container of at least another one of the single-span weirs through the float container of the former one of the single-span weirs or through the float container of still another one of the single-span weirs.

The buckets or float containers of each of the set-up/down plural-span weir assemblies provided in accordance with the present invention are connected to each other through the medium of the up-stream water so that the order of the setting-down of the single-span weirs on the same level of the upstream water (without employing the different levels thereof) can be predetermined.

The level of the upstream water, on which the single-span weirs provided with the bucket-type set-down means are set down in the predetermined order, can be changed by altering the height of a connection pipe for the buckets of the single-span weirs.

DESCRIPTION OF THE PREFERRED EMBODIMENTS

Embodiments of the present invention are hereafter described in detail with reference to the drawings attached hereto. The same reference symbols in FIGS. 1, 2, 3, 4, 5, 6 and 7 denote mutually corresponding portions.

Figure 1:
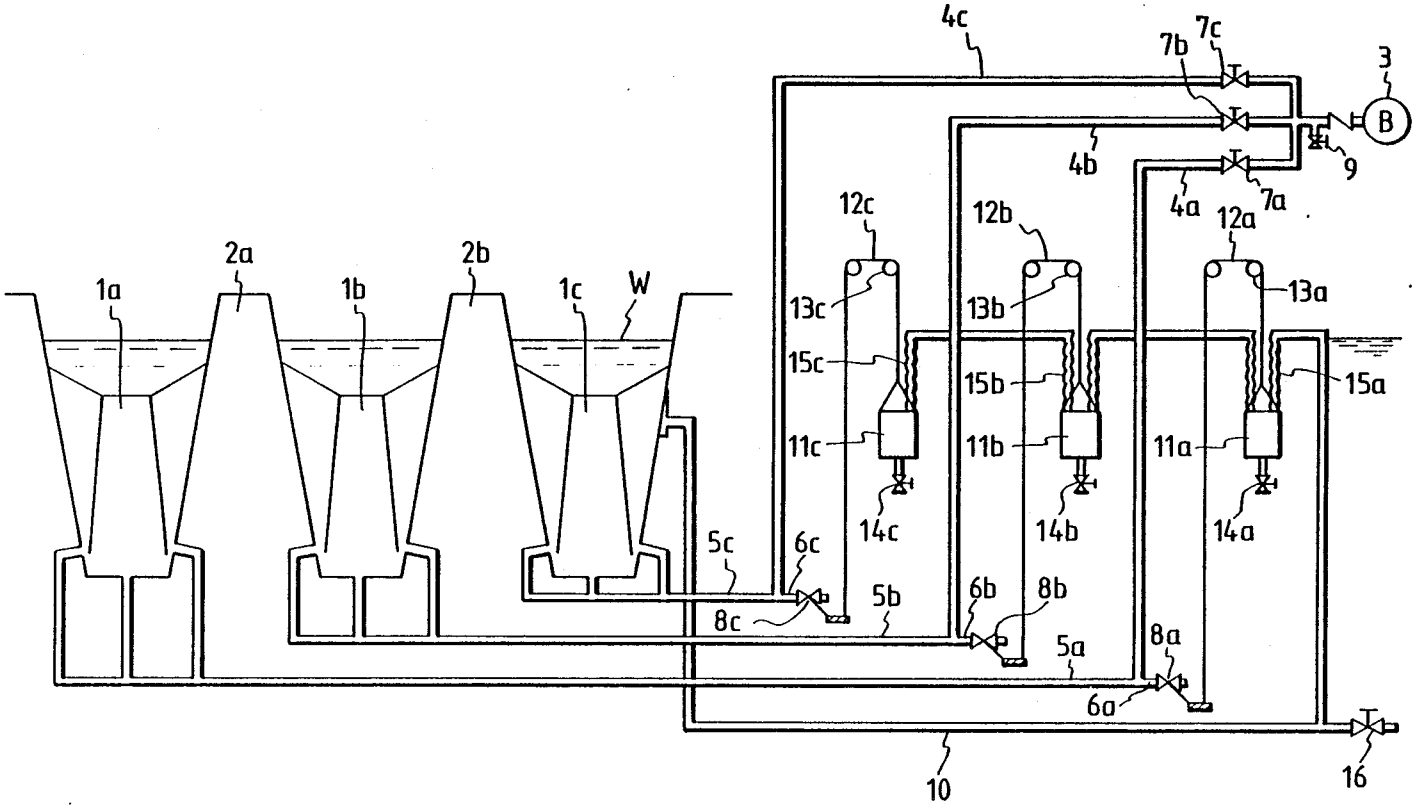
FIG. 1 shows a schematic view of a set-up/down plural-span weir assembly which is an embodiment of the present invention and comprises single-span weirs of flexible sheets and set-down means of the bucket type.

A schematic view of a set-up/down plural-span weir assembly, which is one of the embodiments and has set-down means of the bucket type, is shown in FIG. 1 as seen in the upstream direction of a river in which the weir assembly is installed. The weir assembly has single-span weirs 1*a*, 1*b*, 1*c*, . . . each made of a flexible sheet and capable of being set up and down. The single-span weirs 1*a*, 1*b*, 1*c*, . . . are coupled to each other through pillars 2*a*, 2*b*, . . . so that the set-up/down plural-span weir assembly is constituted. A blower 3 is provided to supply air into the single-span weirs 1*a*, 1*b*, 1*c*, . . . through air feed pipes 4*a*, 4*b*, 4*c*, . . . and air feed/discharge pipes 5*a*, 5*b*, 5*c*, . . . to set up the single-span weirs. The air in the single-span weirs 1*a*, 1*b*, 1*c*, . . . is discharged therefrom through the air feed/discharge pipes 5*a*, 5*b*, 5*c*, and air discharge pipes 6*a*, 6*b*, 6*c*, . . . to set down the single-span weirs. Air feed valves 7*a*, 7*b*, 7*c*, . . . , air discharge valves 8*a*, 8*b*, 8*c*, . . . , a main air feed valve 9, pulleys 13*a*, 13*b*, 13*c*, . . . , valves 14*a*, 14*b*, 14*c*, . . . , bellows pipes 15*a*, 15*b*, 15*c*, . . . and a water discharge valve 16 are provided further. The water discharge valve 16 is fitted in an upstream water level detection pipe 10.

The operation of the set-up/down plural-span weir assembly will be described. The upstream water W of the weir assembly flows through the upstream water level detection pipe 10 laid from the slope of the bank of the river, so that the upstream water is introduced first into the bucket 11*a* of the first single-span weir 1*a*, then into the bucket 11*b* of the second single-span weir 1*b*, then into the bucket 11*c* of the third single-span weir 11*c*, . . . in series. As a result, the buckets 11*a*, 11*b*, 11*c*, . . . are sequentially moved down so that the air discharge valves 8*a*, 8*b*, 8*c*, . . . , which are lever-type butterfly valves, are sequentially opened by wires 12*a*, 12*b*, 12*c*, . . . coupled to the buckets. The air in the single-span weirs 1*a*, 1*b*, 1*c*, . . . is thus sequentially discharged therefrom to sequentially deflate the bags of the weirs to set down the weirs in prescribed order (the weir 1*a* is set down first, the weir 1*b* is set down second, the weir 1*c* is set down third, . . . , as long as the upstream water W exists on an enough level.

Figure 2:
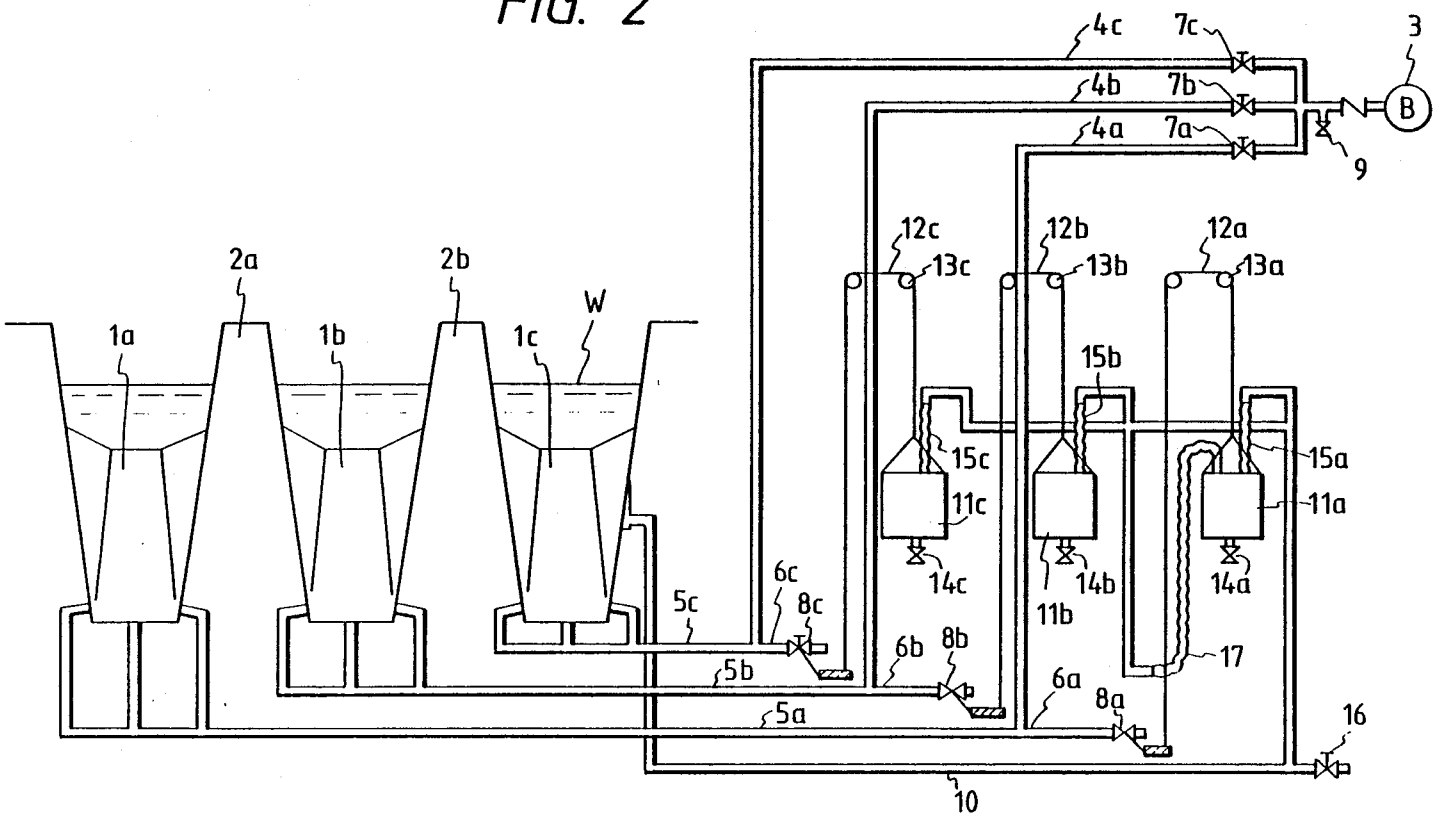
FIG. 2 shows a schematic view of a set-up/down plural-span weir assembly which is another embodiment of the present invention and comprises single-span weirs of flexible sheets and set-down means of the bucket type.

A schematic view of a set-up/down plural-span weir assembly, which is another one of the embodiments and has set-down means of the bucket type, is shown in FIG. 2 as seen in the upstream direction of a river in which the weir assembly is installed. The difference of the weir assembly from that shown in FIG. 1 is that the upstream water W of the weir assembly is directly introduced from an upstream water level detection pipe 10 into a bucket 11*c*. For that reason, the bags of the single-span weirs 1*a*, 1*b*, 1*c*, . . . of the weir assembly shown in FIG. 2 are deflated in prescribed order so that the single-span weirs are set down in that order (the weirs 1*a* and 1*c* are set down before the weir 1*b* is set down) as long as the upstream water W exists on an enough level.

Figure 3:
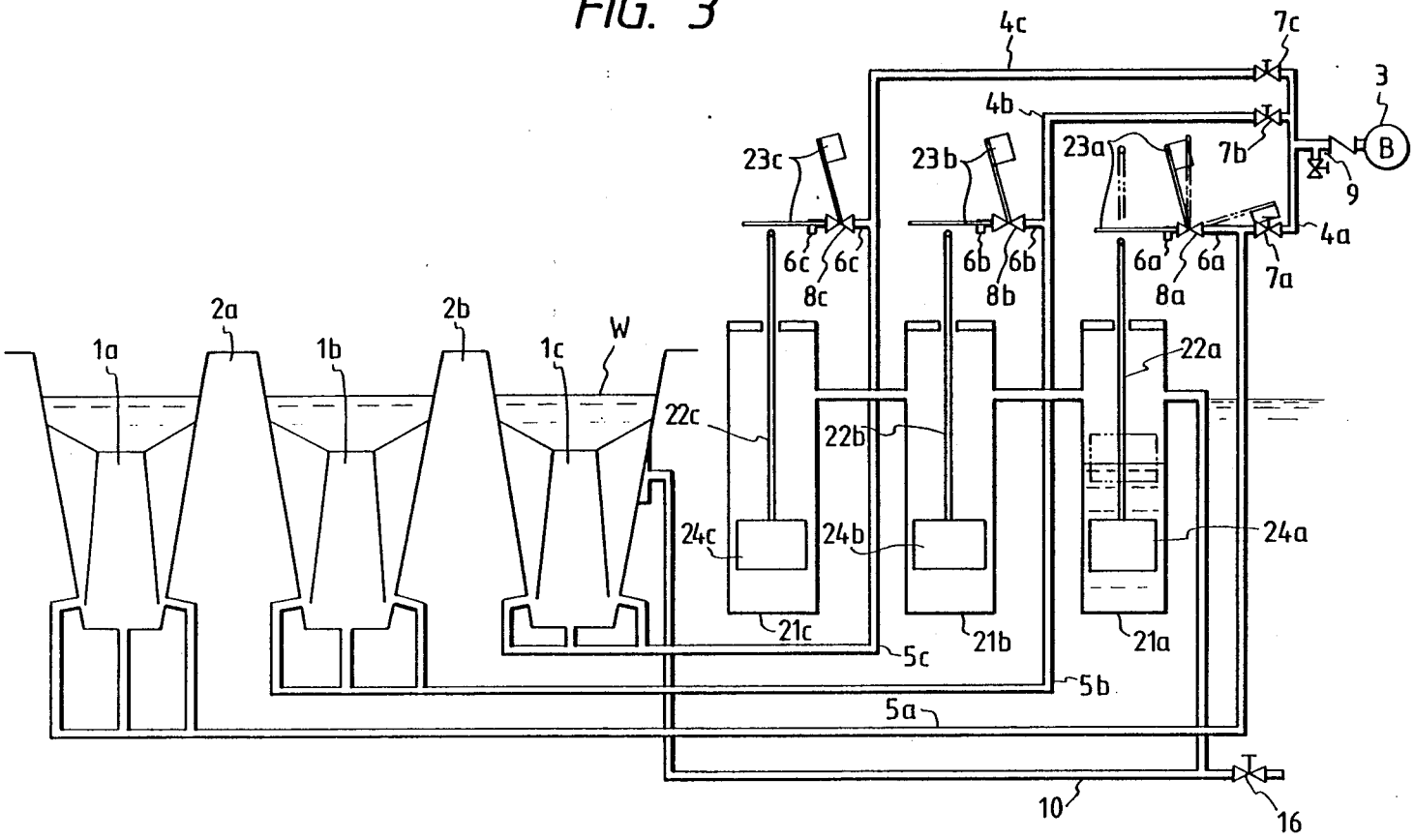
FIG. 3 shows a schematic view of a set-up/down plural-span weir assembly which is still another embodiment of the present invention and comprises single-span weirs of flexible sheets and set-down means of the float type.

A schematic view of a set-up/down plural-span weir assembly, which is still another one of the embodiments and has set-down means of the float type, is shown in FIG. 3 as seen in the up-stream direction of a river in which the weir assembly is installed. The weir assembly has single-span weirs 1*a*, 1*b*, 1*c*, . . . each made of a flexible sheet and capable of being set up and down. The single-span weirs 1*a*, 1*b*, 1*c*, . . . are coupled to each other through pillars 2*a*, 2*b*, . . . across the stream of the river so that the set-up/down plural-span weir assembly is constituted. A blower 3 is provided to supply air to the single-span weirs 1*a*, 1*b*, 1*c*, . . . through air feed pipes 4*a*, 4*b*, 4*c*, . . . and air feed/discharge pipes 5*a*, 5*b*, 5*c*, . . . to set up the single-span weirs. The air in the single-span weirs 1*a*, 1*b*, 1*c*, . . . is discharged therefrom through the air feed/discharge pipes 5*a*, 5*b*, 5*c*, . . . and air discharge pipes 6*a*, 6*b*, 6*c*, . . . to set down the single-span weirs. Air feed valves 7*a*, 7*b*, 7*c*, . . . , air discharge valves 8*a*, 8*b*, 8*c*, . . . , a main air feed valve 9 and a water discharge valve 16 are provided further. The water discharge valve 16 is fitted in an upstream water level detection pipe 10.

The operation of the set-up/down plural-span weir assembly shown in FIG. 3 will be described. The upstream water W of the weir assembly flows through the upstream water level detection pipe 10 laid from the slope of the bank of the river, so that the upstream water is introduced first into the float container 21*a* of the first single-span weir 1*a*, then into the float container 21*b* of the second single-span weir 1*b*, then into the float container 21*c* of the third single-span weir 1*c*, . . . in series. As a result, the floats 24*a*, 24*b*, 24*c*, . . . in the float containers 21*a*, 21*b*, 21*c*, . . . are buoyed up to lift rods 22*a*, 22*b*, 22*c*, . . . to sequentially push up counterweights 23*a*, 23*b*, 23*c*, . . . attached to the air discharge valves 8*a*, 8*b*, 8*c*, . . . The air discharge valves 8*a*, 8*b*, 8*c*, . . . are thus sequentially opened to sequentially discharge the air out of the single-span weirs 1*a*, 1*b*, 1*c*, . . . to set down the single-span weirs in prescribed order (the weir 1*a* is set down first, the weir 1*b* is set down second, the weir 1*c* is set down third, . . . ) as long as the upstream water W exists on an enough level.

Figure 4:
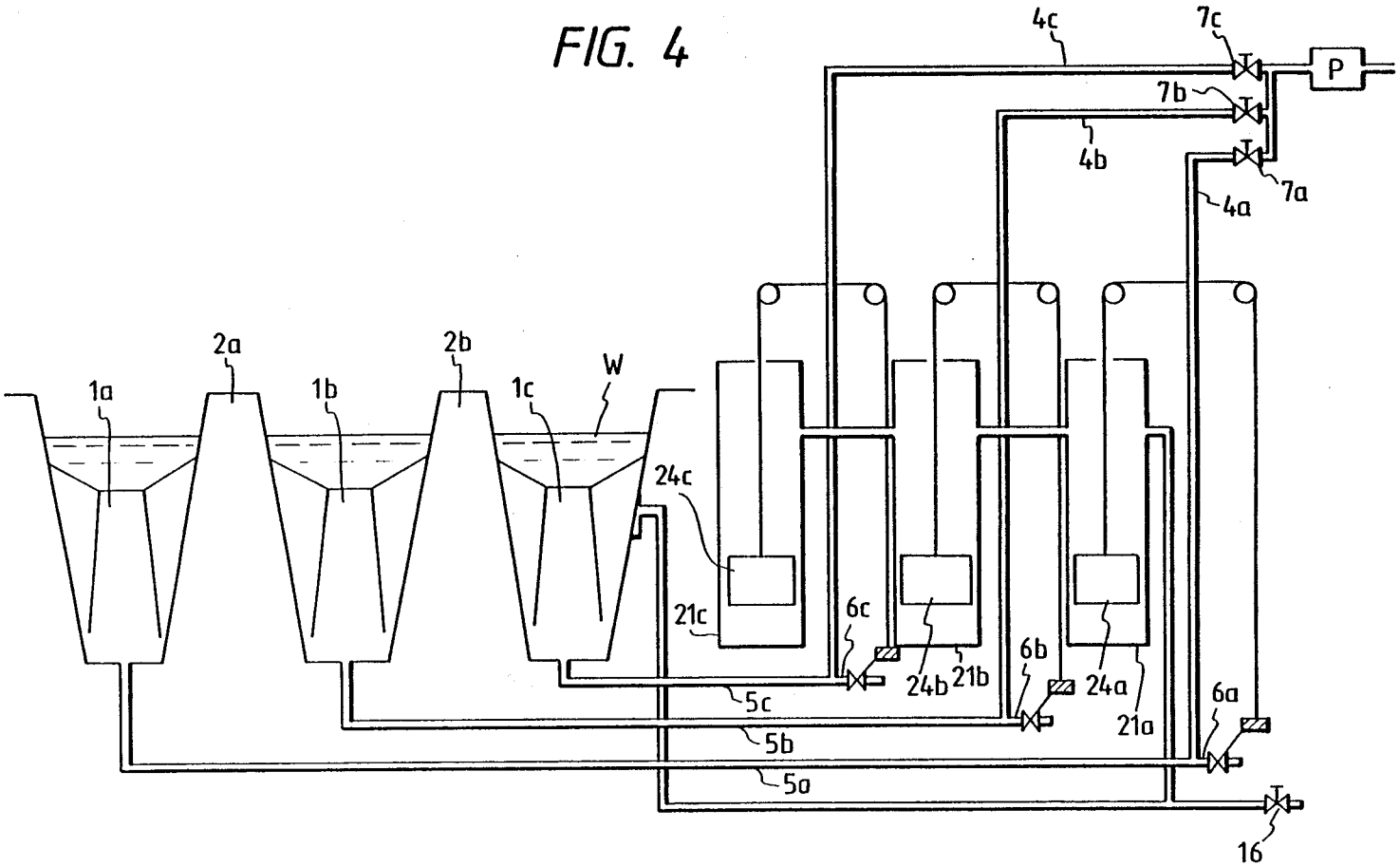
FIG. 4 shows a schematic view of a set-up/down plural-span weir assembly which is still another embodiment of the present invention and comprises single-span weirs of flexible sheets and set-down means of the float type.

Although the single-span weirs of the set-up/down plural-span weir assembly shown in FIG. 3 are inflated by the air, the present invention is not confined thereto but may be otherwise embodied so that the single-span weirs of a set-up/down plural-span weir assembly having set-down means of the float type are inflated by water as shown in FIG. 4. In that other embodiment, water discharge pipes are provided in lower positions instead of air discharge pipes in upper positions, and wires are attached to floats instead of rods and laid on pulleys to open water discharge valves in the water discharge pipes.

Figure 5:
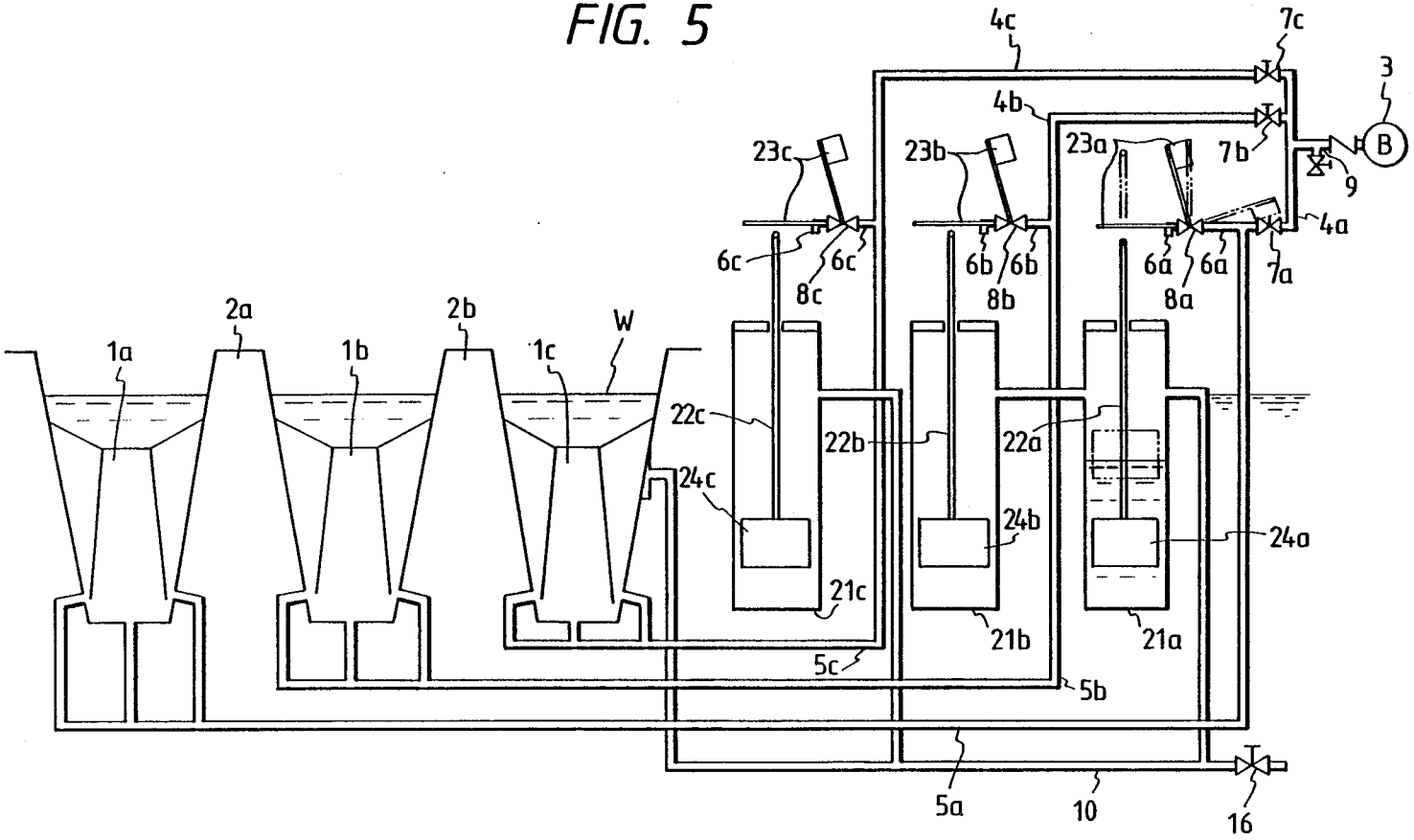
FIG. 5 shows a schematic view of a set-up/down plural-span weir assembly which is still another embodiment of the present invention and comprises single-span weirs of flexible sheets and set-down means of the float type.
Figure 6:
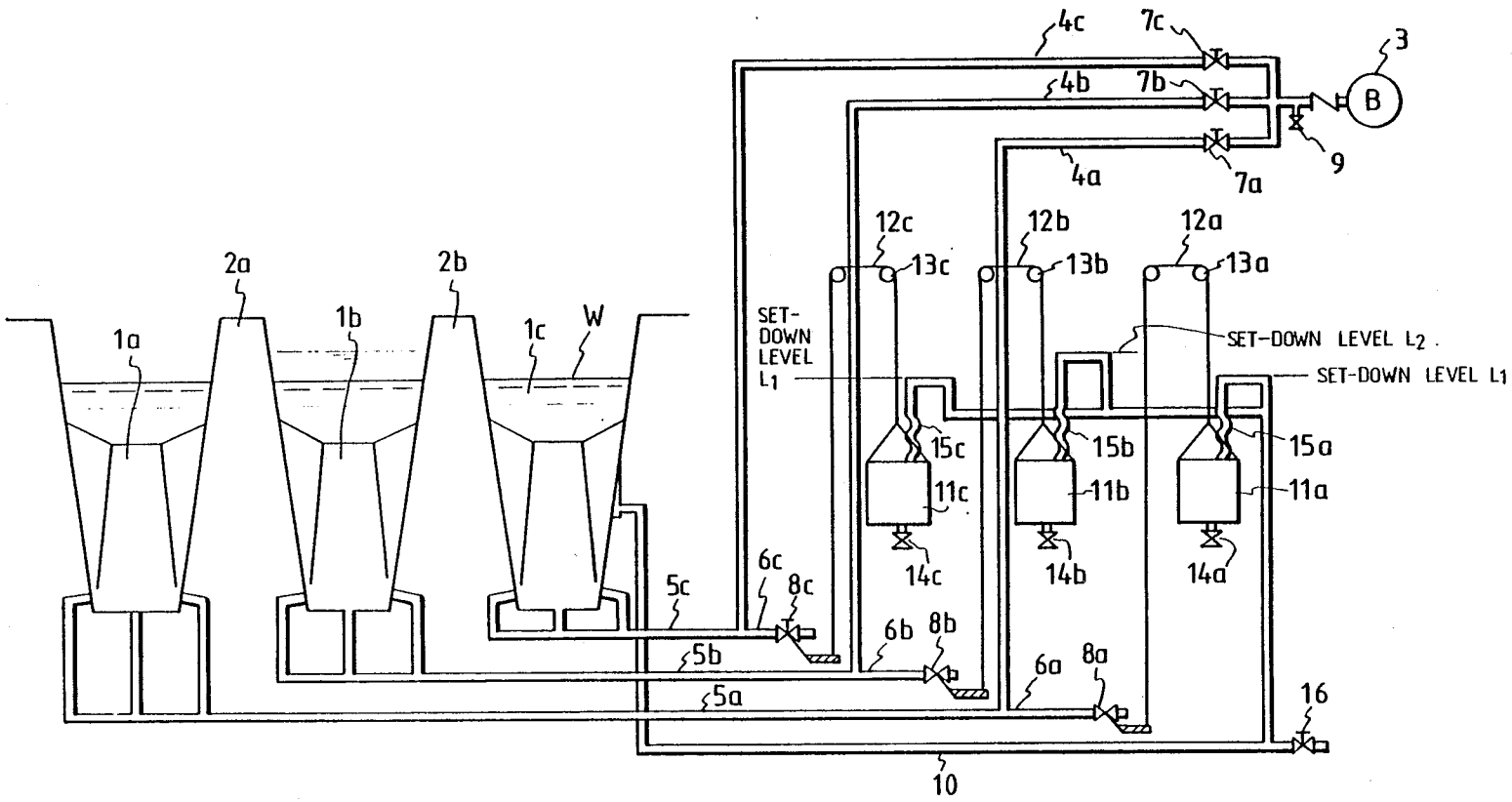
FIG. 6 shows a schematic view of a conventional set-up/down plural-span weir assembly comprising single-span weirs of flexible sheets and set-down means of the bucket type.
Figure 7:
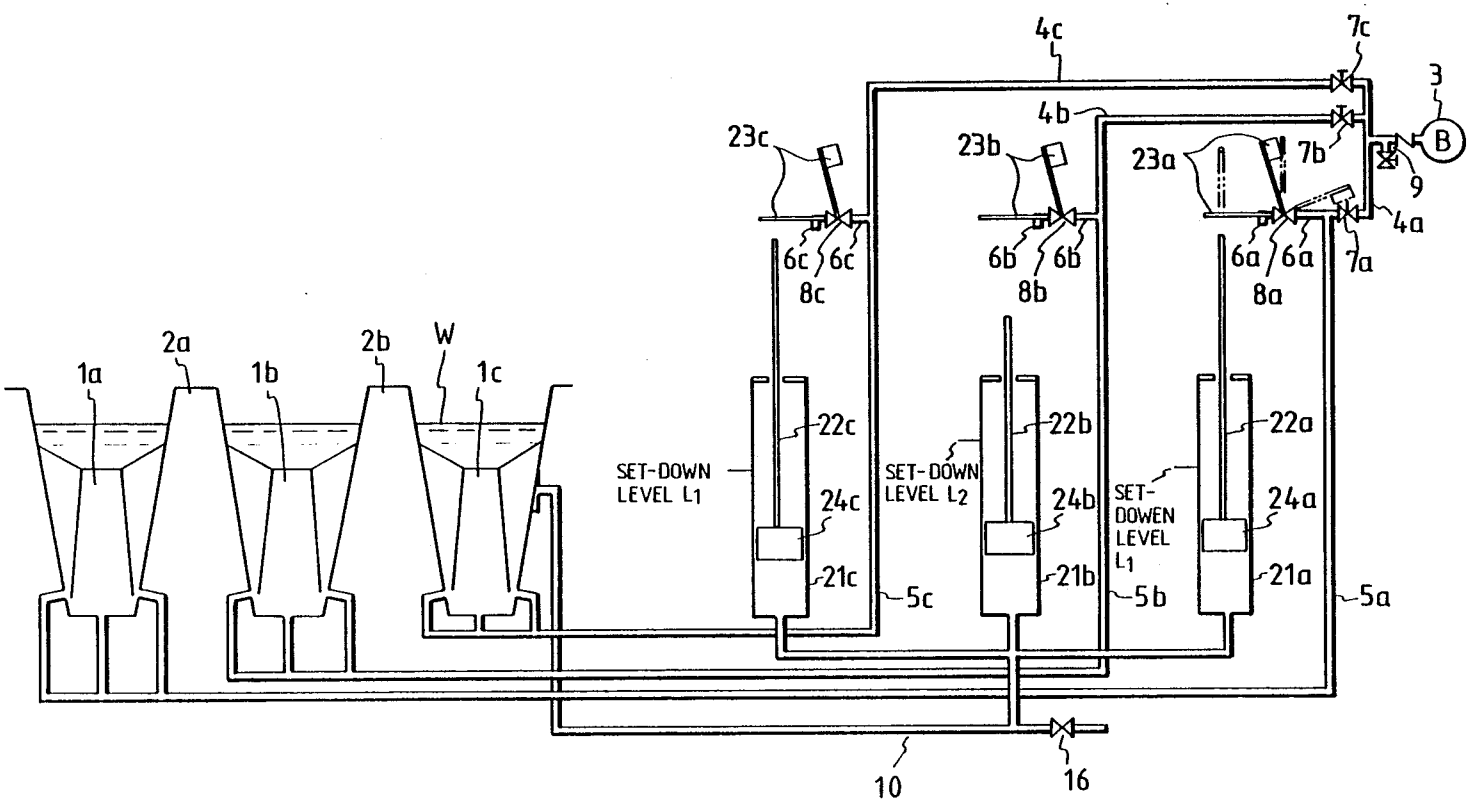
FIG. 7 shows a schematic view of a conventional set-up/down plural-span weir assembly comprising single-span weirs of flexible sheets and set-down means of the flat type.

A schematic view of a set-up/down plural-span weir assembly, which is still another one of the embodiments and has set-down means of the float type, is shown in FIG. 5 as seen in the upstream direction of a river in which the weir assembly is installed. The difference of the weir assembly from that shown in FIG. 3 is that the upstream water W of the weir assembly is directly introduced from an upstream water level detection pipe 10 into a float container 21*c*. A a result, the bags of the single-span weirs 1*a*, 1*b*, 1*c*, . . . of the set-up/down plural-span weir assembly shown in FIG. 5 are deflated in prescribed order so that the single-span weirs are set down in that order (the weirs 1*a* and 1*c* are set down before the weir 1*b* is set down) as long as the upstream water W exists on an enough level.

The present invention is not confined to the above-described embodiments but may be embodied in other various ways. The set-down means of each set-up/down plural-span weir assembly provided in accordance with the present invention may operate so that each of the single-span weirs of the weir assembly or every plurality of them is set down in prescribed order depending on the speed of the increase in the flow rate of the river in which the weir assembly is installed. Besides, the set-down means may be of either the air inflation type or the water inflation type.

According to the present invention, a set-up/down plural-span weir assembly is composed of a plurality of single-span weirs each made of a flexible sheet and capable of being set up and down. The single-span weirs can be easily set down in prescribed order on the same level of the upstream water of the weir assembly.

What is claimed is:

1. A set-up/down plural-span weir assembly made of flexible sheets, in which a plurality of bags made of said sheets and constituting the bodies of single-span weirs are mounted on the bed of a river; an pressure medium such as air or water is introduced into said bags to inflate them to set up said weirs; said pressure medium in said bags is descharged therefrom to deflate them to set down; said weirs are coupled to each other through pillars across the stream of said river so that said assembly is constituted; and said weirs are provided with set-down means by which the upstream water of said assembly is introduced into buckets of said weirs through an upstream water level detection pipe to move down said buckets to open air or water discharge valves in air or water discharge pipes communicating with said bags of said weirs, to deflate said bags as said upstream water is on a prescribed level, characterized in that said upstream water is directly introduced from said upstream water level detection pipe into said bucket of at least one of said weirs; and said upstream water is indirectly introduced from said upstream water level detection pipe into said bucket of at least another one of said weirs through the bucket of the former one of said weirs or through the bucket of still another one of said weirs.

2. A set-up/down plural-span weir assembly made of flexible sheets, in which bags made of said sheets and constituting the bodies of single-span weirs are mounted on the bed of a river; a pressure medium such as air and water is introduced into said bags to inflate them to set up said weirs; said pressure medium in said bags is discharged therefrom to deflate them to set down said weirs; said weirs are coupled to each other through pillars across the stream of said river so that said assembly is constituted; and said weirs are provided with set-down means by which the upstream water of said assembly is introduced into float containers of said weirs through an upstream water level detection pipe to move up floats in said float containers to open air or water discharge valves in air or water discharge pipes communicating with said bags of said weirs, to deflate said bags as said upstream water is on a prescribed level, characterized in that said upstream water is directly introduced from said upstream water level detection pipe into said float container of at least one of said weirs; and said upstream water is indirectly introduced from said upstream water level detection pipe into the float container of at least another one of said weirs through said float container of the former one of said weirs or through said float container of still another one of said weirs.

* * * * *